United States Patent [19]

Jacobson

[11] 4,125,909

[45] Nov. 21, 1978

[54] COMBINATION SLEEPING BAG AND HAMMOCK

[76] Inventor: Daniel H. Jacobson, c/o Goodwin, 54 Hill St., Cooma N.S.W., Australia

[21] Appl. No.: 818,079

[22] Filed: Jul. 22, 1977

[51] Int. Cl.[2] ..... A45F 3/24

[52] U.S. Cl. ..... 5/121

[58] Field of Search ..... 5/120–130, 5/343; 248/156

[56] References Cited

U.S. PATENT DOCUMENTS

| | | | |
|---|---|---|---|
| 1,257,984 | 3/1918 | Drexler | 5/120 |
| 2,251,299 | 8/1941 | Spangler | 5/130 |
| 2,745,115 | 5/1956 | Reiss | 5/122 |
| 2,769,989 | 11/1956 | Woodford | 5/319 |
| 3,341,200 | 9/1967 | Brandley | 248/156 |
| 3,675,256 | 7/1972 | Tallarico et al. | 5/120 |

*Primary Examiner*—Richard E. Moore

*Attorney, Agent, or Firm*—Leonard W. Suroff

[57] ABSTRACT

A combination hammock and sleeping bag having a flexible elongated base with flexible rigidity means extending peripherally around the base, and mounting means including an aperture at each end of the base so as to permit the base to be suspended above the ground. A sleeping compartment of flexible water repellent material having a longitudinally extending opening for access thereto by the user of the sleeping bag is releasably connected between the sleeping compartment and the base, with support means at each end of the sleeping compartment extending transversely thereto and enclosed by the repellent material. The support means being self adjusting to accommodate different size users of the sleeping compartment.

10 Claims, 5 Drawing Figures

COMBINATION SLEEPING BAG AND HAMMOCK

BACKGROUND OF THE INVENTION

The invention relates to a combination of a hammock and sleeping bag.

The prior art devices that incorporate a hammock and sleeping bag are illustrated in U.S. Pat. No. 2,321,966. The present invention improves upon the structure disclosed in this patent in order to provide a more convenient and versatile hammock and sleeping bag.

Without question, the field of camping has become most popular and the need for a sleeping bag that is suspended off the ground and yet comfortable has been demonstrated.

OBJECTS OF THE INVENTION

An object of the present invention is to provide a combined hammock and sleeping bag adapted to be readily suspended above the ground and which affords protection to the user against inclement weather conditions and cold.

Another object of the present invention is to provide a hammock and sleeping bag which may be used in combination or separately.

Another object of the present invention is to provide a hammock and sleeping bag in which the means for supporting the combination thereof is provided therewith.

Other objects and advantages of the present invention will become apparent as the disclosure proceeds.

SUMMARY OF THE INVENTION

A combination hammock and sleeping bag having a flexible elongated base with flexible rigidity means extending peripherally around the base, and mounting means including an aperture at each end of the base so as to permit the base to be suspended above the ground. A sleeping compartment of flexible water repellent material having a longitudinally extending opening for access thereto by the user of the sleeping bag is releasably connected between the sleeping compartment and the base, with support means at each end of the sleeping compartment extending transversely thereto and enclosed by the repellent material. The support means being self adjusting to accommodate different size users of the sleeping compartment.

The flexible rigidity means includes a rope or the like fully enclosed by the base. The support means includes a pair of first tubular support members having one end thereof secured to one side of the sleeping compartment, and a second pair of tubular support members in telescopic relationship to the first support members. Suspension means is provided for use in conjunction with the mounting means to suspend the base above the ground at a variety of adjustable height levels.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 2:
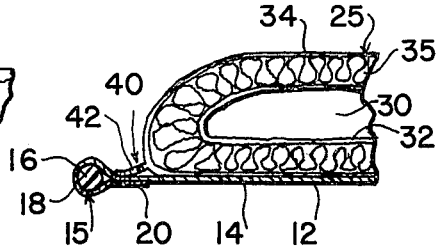
FIG. 2 is an enlarged fragmentary sectional view taken along line 2—2 of FIG. 1.

Referring now to the drawings, there is illustrated in FIGS. 1-5 a combination hammock and sleeping bag 10 that includes a flexible elongated base 12 having spaced apart ends 14. The base 12 may be made from a Nylon sheet or other material that is strong and preferably water repellent. To strengthen the base 12, flexible rigidity means 15 is provided and extending peripherally around the base 12. The rigidity means 15 includes a rope, or the like, 16 fully enclosed by the peripheral margin 18 of the base 12. The peripheral margin 18, as illustrated in FIG. 2, includes a lip 20 extending in overlapping relationship to the base 12. In this manner the rope 16 is fully enclosed and strengthens the base 12.

A sleeping compartment 25 of flexible water repellent material having a longitudinally extending opening 26 for access thereto by the user of the sleeping bag is provided. The sleeping compartment 25 includes an outer contoured configuration 28 and having an interior 30 defined by an inner wall 32 and a spaced apart outer wall 34 with insulated material 35 extending therebetween. The longitudinally extending opening 26 may have a zipper or other means of closing same with a head opening 36 at the upper end thereof. The respective inner wall 32 and outer wall 34 may be made from a variety of materials, such as Nylon, to provide maximum protection to the user from the weather.

Releasable connecting means 40 is provided between the sleeping compartment 25 and the base 12. The releasable connecting means 40, as illustrated in FIG. 2, may include a zipper 42 peripherally extending around the sleeping compartment 25 for securement to the base 12.

The combined hammock and sleeping bag 10 further includes support means 45 at each end 46 of the sleeping compartment 25. The purpose of the support means is to provide additional rigidity to the device 10 and further enhance the sleeping comfort of the user. A hammock generally has a tendency to curl up to the contour of the body thereon to the point that it often becomes uncomfortable, and particularly when sleeping thereon for a number of hours.

The support means 45 provides a rigid frame to the device 10 to prevent a complete bending of the hammock to the contour of the user thereof. By providing these support means extending transversely at each end of the sleeping compartment 25, additional comfort and convenience is provided. The support means is fully enclosed by the repellent material of the sleeping compartment 25 and is also self adjusting as to the width thereof to accommodate different size users of the sleeping compartment.

Figure 1:
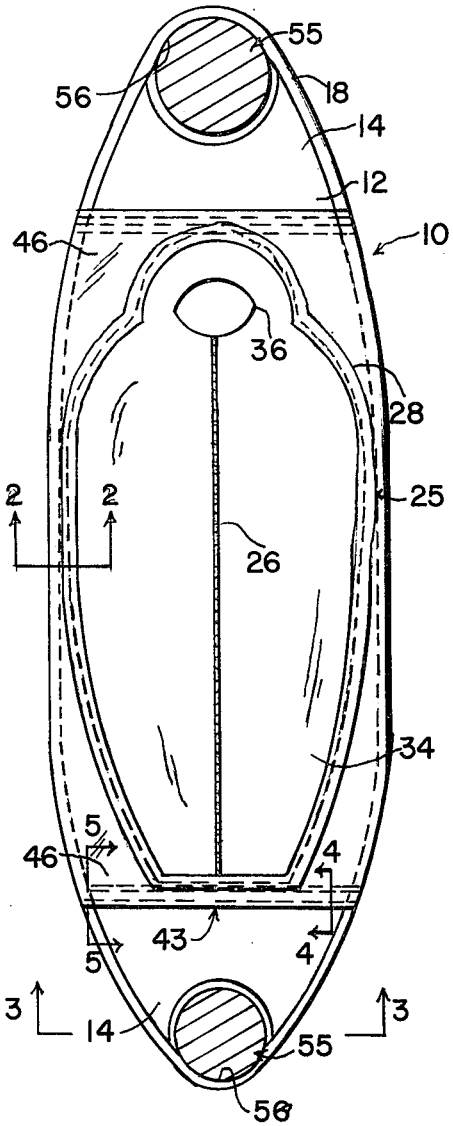
FIG. 1 is a top plan view of the combined hammock and sleeping bag in accordance with the present invention.
Figure 4:
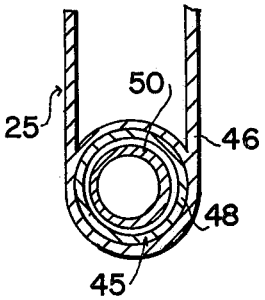
FIG. 4 is a fragmentary enlarged sectional view taken along line 4—4 of FIG. 1.

The support means 45 includes a pair of first tubular or outer support members 48 and a second pair or inner tubular support members 50, as illustrated in FIG. 4.

Figure 5:
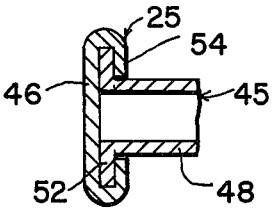
FIG. 5 is an enlarged fragmentary view taken along line 5—5 of FIG. 1.

Each tubular support member 48 and 50 includes an enlarged head 52, as illustrated in FIG. 5, which is secured to the sleeping compartment 25 as by a peripheral lip 54 extending therearound. The support members 48 and 50 are mounted in telescopic interfitting relationship with each other and having a respective pair thereof at each end 46 of the sleeping compartment 25. In view of the fact that each outer end of a support member 48 and 50 is secured in fixed relationship to the outer margin of the sleeping compartment 25, adjustment in the width thereof will automatically take place if the physical size of the user requires same. Thus an expansion of the support members 48 and 50 to an appropriate dimension can take place by the user either entering the compartment 30 or by manually pulling apart the support members 48 and 50. If desired, support members 48 and 50 may be collapsed by engaging each enlarged head 52 and pushing them towards each other to longitudinally adjust the relative position of the telescopic supports.

Mounting means 55 is provided at each end 14 of the base 12 and may include an aperture 56 utilized to suspend the device 10 above the ground. The mounting means 55 may be supported on various posts, etc.

Figure 3:
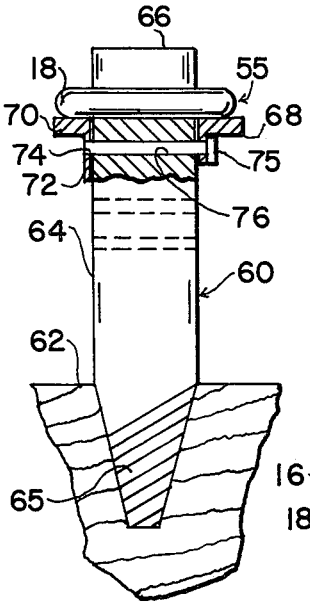
FIG. 3 is a sectional view of the suspension means taken along line 3—3 of FIG. 1.

In view of the fact that it is not always possible to have available ideally suited supports for the combination hammock and sleeping bag 10, suspension means 60 is provided for engagement with the ground 62 and adapted to be operatively associated with the mounting means at each end of the base 12. The suspension means includes a pair of posts 64 having a tapered and threaded front end 65 to facilitate securement to the ground. The post 64 has an upper end 66 and of a diameter to be received through the aperture 56 of the mounting means 55. A pair of posts 64 are provided with each device 10 and may vary in diameter with a larger post being utilized at the end of the sleeping bag adjacent the head of the user. The suspension means 60 may further include a suspension plate 68, as illustrated in FIG. 3, including an outwardly extending flange 70 adapted to have the peripheral end 18 of the base 12 seated thereon. The suspension plate 68 may have a lower collar 72 having a pair of apertures 74 in axial alignment with each other for receiving therethrough a pin 75. The pin 75 extends through one of a plurality of transversely extending apertures 76 in the post 64, such that the plate 68 may be adjusted to different elevational heights.

In this manner the user of the device 10 may select the height at which he or she desires to sleep above the ground. In addition, the aperture 68 provides a dual function in that a rod can be positioned therethrough to aid in rotation of the post 64 for securement to the ground 62.

The combined hammock and sleeping bag 10 as described herein provides for the user a convenience in that the sleeping compartment 25 and the base 12 may be individually used, or either one may be replaced due to damage, etc. In addition, a heavyweight sleeping bag could be used for the winter months and a lightweight sleeping bag could be used for the summer months. The present invention permits this interchangeability. Furthermore, the necessary means are provided to suspend the device 10 above the ground in a convenient manner, which can be very important in camping, etc.

Although an illustrative embodiment of the invention has been described in detail herein with reference to the accompanying drawings, it is to be understood that the invention is not limited to the precise embodiment and that various changes and modifications may be effected therein without departing from the scope or spirit of the invention.

I claim:

1. A combination hammock and sleeping bag, comprising:

a. a flexible elongated base, b. flexible rigidity means extending peripherally around said base, c. mounting means including an aperture at each end of said base so as to permit said base to be suspended above the ground, d. a sleeping compartment of flexible water repellent material having a longitudinally extending opening for access thereto by the user of the sleeping bag, e. releasable connecting means between said sleeping compartment and said base, and f. support means at each end of said sleeping compartment extending transversely thereto and enclosed by said repellent material, said support means being self adjusting to accommodate different size user of said sleeping compartment.

2. A combination hammock and sleeping bag as in claim 1, wherein said flexible rigidity means includes a rope or the like fully enclosed by said base.

3. A combination hammock and sleeping bag as in claim 1, wherein said support means includes:

a. a pair of first tubular support members having one end thereof secured to one side of said sleeping compartment, and b. a second pair of tubular support members mounted in telescopic interfitting relationship with each of said first pair of said tubular support members and having one end thereof secured to the other side of said sleeping compartment, so as to provide adjustment in the width of said sleeping compartment at each end thereof such that the physical size of the user thereof will cause an expansion of said support members to an appropriate dimension.

4. A combination hammock and sleeping bag as in claim 3, wherein said support members include an enlarged head at each end thereof for securement to said sleeping compartment, and said heads may be engaged to longitudinally adjust the relative positions of said telescopic support members.

5. A combination hammock and sleeping bag as in claim 1, wherein said releasable connecting means includes a zipper for removal of said sleeping compartment from said base.

6. A combination hammock and sleeping bag as in claim 1, and further including suspension means for engagement with the ground and adapted to be operatively associated with said mounting means at each end thereof.

7. A combination hammock and sleeping bag as in claim 6, wherein said suspension means includes:

a. a pair of posts adapted to be secured within the ground at one end thereof, with the opposite end for extension through said aperture of said mounting means, and b. a suspension plate mounted on each said post to support said mounting means at a selected height above the ground.

8. A combination hammock and sleeping bag as in claim 7, and further including adjustment means for mounting said plate at different elevational levels, said adjustment means including:

a. a plurality of transversely extending apertures in each said post, and b. a pin adapted to extend within said apertures and having said plate supported thereon.

9. A combination hammock and sleeping bag as in claim 8, wherein said post has a threaded tapered front end to facilitate securement to the ground.

10. A combination hammock and sleeping bag as in claim 9, wherein said apertures are utilized to assist in rotation of said post for securement to the ground of said threaded end.

* * * * *